US005713343A

United States Patent [19]

Taylor et al.

[11] Patent Number: 5,713,343

[45] Date of Patent: Feb. 3, 1998

[54] RECREATIONAL SURVIVAL LIGHT/STOVE WATER HEATER UNIT

[76] Inventors: Ralph W. Taylor, 100 Huntington Dr. A 206, Naples, Fla. 34109; Nathan H. Mazer, 5483 S. 2375 W., Ogden, Utah 84067

[21] Appl. No.: 489,333

[22] Filed: Jun. 12, 1995

[51] Int. Cl.[6] ..... F24C 1/14

[52] U.S. Cl. ..... 126/4; 126/5; 126/37 R; 126/261; 126/267; 362/253

[58] Field of Search ..... 126/4, 5, 37 R, 126/261, 262, 267; 431/267; 362/253

[56] References Cited

U.S. PATENT DOCUMENTS

| | | | |
|---|---|---|---|
| 198,294 | 12/1877 | Haight | 126/267 |
| 1,065,813 | 6/1913 | Kolasa | 126/267 |
| 1,122,196 | 12/1914 | Decker | 126/267 |
| 3,381,678 | 5/1968 | Fry | 126/4 |
| 3,408,998 | 11/1968 | Brancato et al. | 126/4 |
| 4,122,764 | 10/1978 | D'Ambra | 126/265 |
| 5,096,413 | 3/1992 | Suzuki et al. | 431/267 |

OTHER PUBLICATIONS

Brochure: Action Technology, Inc., "How to Use and Enjoy Your 'Little Magician'".

Packaging: "Lantern Lighter", Coghlan's, Ltd., 1987.

*Primary Examiner*—Larry Jones

[57] ABSTRACT

An apparatus for outdoor recreation and survival which provides five simultaneous functions: portability, light, heat, a friction ignition system and a liquid heating system. It combines together elements of a burner fueled by a commercially available propane tank, mounted in a housing where the burner can provide both light and heat simultaneously when lit. The apparatus can simultaneously be transported by use of a handle attached to the housing. Light and heat are maximized through the use of reflective surfaces inside the housing which surround the burner. The improvement comprises a friction igniter attached to the housing for the safe and efficient lighting of the burner. The igniter is attached to the housing through a door/framework containing fire resistant glass to protect the user from any flames during ignition and use thereafter. Furthermore, an improved liquid container provides an energy efficient kettle that heats liquids. It is held snugly to the heating grill with guides so that water can be boiled in the container while the stove is being carried. The guides allow the easy removal of the liquid container from the grill. The liquid container is contoured to match the shape of the grill to maximize heat transfer from the grill to the liquid container.

2 Claims, 9 Drawing Sheets

RECREATIONAL SURVIVAL LIGHT/STOVE WATER HEATER UNIT

BACKGROUND OF THE INVENTION

1. Field of the Invention

The invention relates to the field of outdoor recreational and survival apparatuses which generate both a light source and heat for cooking. In particular it concerns an improved combination of old elements to create a portable, compact and convenient unit which is suitable for general recreation, camping, or survival during times of disasters such as earthquakes, floods or civil uprisings.

2. Description of the Related Art

There has been a long felt need by campers and survivalists for a apparatus which combines five simultaneous functions: portability, light, heat, a friction ignition system, and a liquid heating system. While there are many commercially available portable lanterns, stoves, friction ignitor systems and liquid heating systems, there has not there-to-fore been available the improved combination thereof.

Traditionally, outdoor light and heat sources are purchased and used as separate units. Lanterns are used only for light; stoves are used only for heat. It is difficult if not impossible to purchase a lantern that simultaneously functions as both a light source and heat source.

While camping, the instruments typically used to ignite the traditional gas burner on either a lantern or a stove is a match or cigarette lighter. Igniting a gas burner by these methods is unsafe. They require that fingers and hands be placed near the burner to light it. Hands and arms can easily be singed. As a source of ignition, matches and cigarette lighters are unreliable over time and useless when lost, old or wet. Seldom, if ever, is a gas burner ignited by a permanently attached friction ignitor system designed such that fingers do not get close to the burner.

The liquid heating system typically used to boil water on a gas stove is not designed to efficiently heat liquids. Liquid containers are not designed with a particular heating grill shape or size in mind. Typically, water heating containers are purchased separately from the stove upon which it is to be used. Therefore its shape bears little or no relationship to the shape of the stove heating surface. Furthermore, a liquid container is never traditionally designed with guides to hold the liquid container in place on the grill.

For the camper or person preparing a survival kit, no apparatus is available on the market which can perform these five critical functions simultaneously: portability, light, heat, a friction ignitor system and a liquid heating system.

The traditional use of a lantern and stove as separate apparatuses is a waste of energy and storage space. The use of matches or a cigarette lighter for igniting the gas burner of a lantern or stove is dangerous, inconvenient and unreliable. The use of odd shaped pots and pans for boiling water and cooking food is a waste of energy, a waste of storage space and unsafe, These problems are solved by the present invention. This invention synergistically combines the old elements of a portable lantern, stove, friction ignitor and liquid heating system into a single portable apparatus where all these functions uniquely can be performed simultaneously.

SUMMARY OF THE INVENTION

It is the object of the present invention to overcome the shortcomings of the prior art.

It is a further object of the invention to provide a safe, compact, convenient and reliable source of light and heat simultaneously.

It is an additional object of the invention to provide the simultaneous light and heat source with a safe reliable and permanent friction ignitor system. The gas burner can be lit without the need for matches or cigarette lighters. The user is provided protection from direct exposure to the burner when it is being lit and thereafter during its use as lantern/stove.

It is a further object of the invention to provide a safe, portable, compact, convenient, reliable and efficient source of boiled water or liquids.

To accomplish the first and second objectives, an improved apparatus was invented which combines together the old elements of a burner mounted inside a housing where the burner provides both light and heat simultaneously when lit; the lantern/stove can simultaneously be transported by use of a handle attached to the housing. Light and heat are maximized through the use of reflective surfaces surrounding the burner. The improvement comprises a friction ignitor attached to the housing through a door/framework containing fire resistant glass. Both the friction ignitor and the fire resistant glass protect the user from ever being scorched by the burner.

To accomplish the third objective, an improved liquid container was invented with an energy efficient shape that can be held snugly in place upon the heating grill; the heating grill contains a plurality of guides so that the liquid container can be held in place on the grill by the guides; the guides allow the stove itself to be transported from place to place while the liquids heat. The guides also allow for the removal of the liquid container from the grill. The liquid heating container is a kettle with contours in the shape of the heating grill to maximize heat transfer from the burner to the liquid. The container has a spout for liquids to enter and exit it as well as a collapsible handle for transport of the container itself. A storage space is provided inside the housing which is secured by a door and latch.

BRIEF DESCRIPTION OF THE DRAWINGS

These and other objects, aspects and embodiments of the present invention will be described with reference to the attached drawing figures, of which.

DETAILED DESCRIPTION

Figure 1:
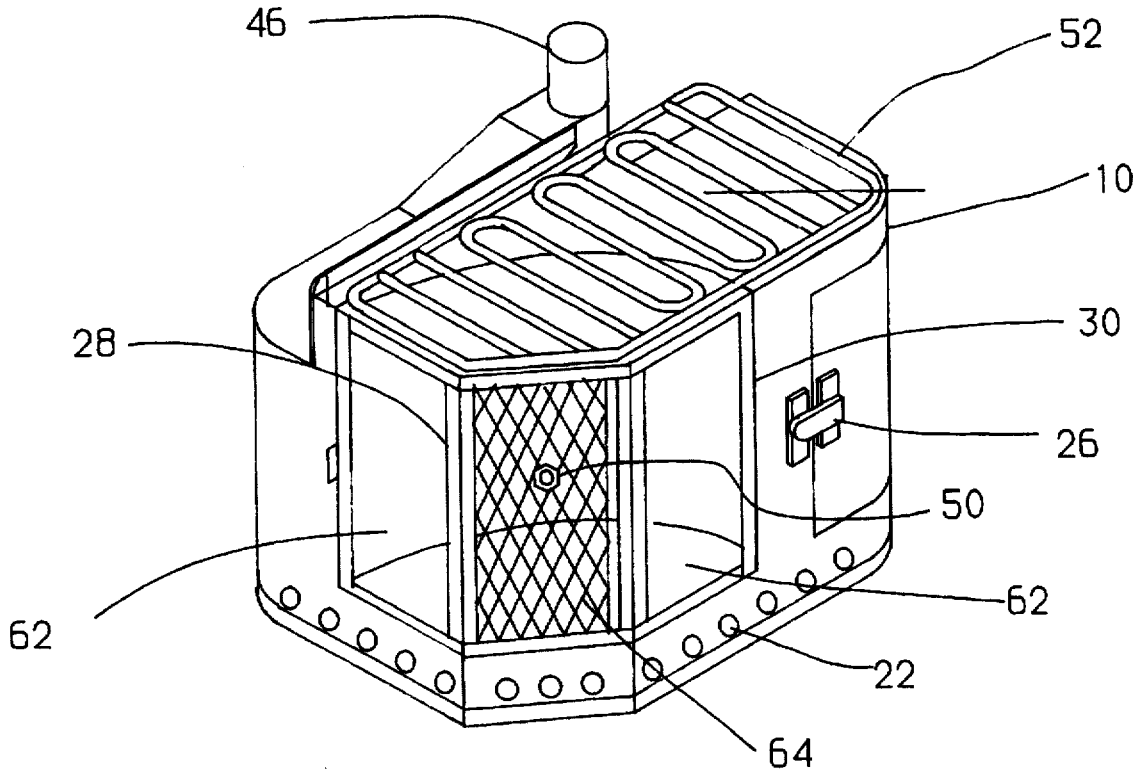
FIG. 1 is a perspective view of the invention in a combined top and frontal view of the light/stove water heating unit according to the invention.
Figure 2:
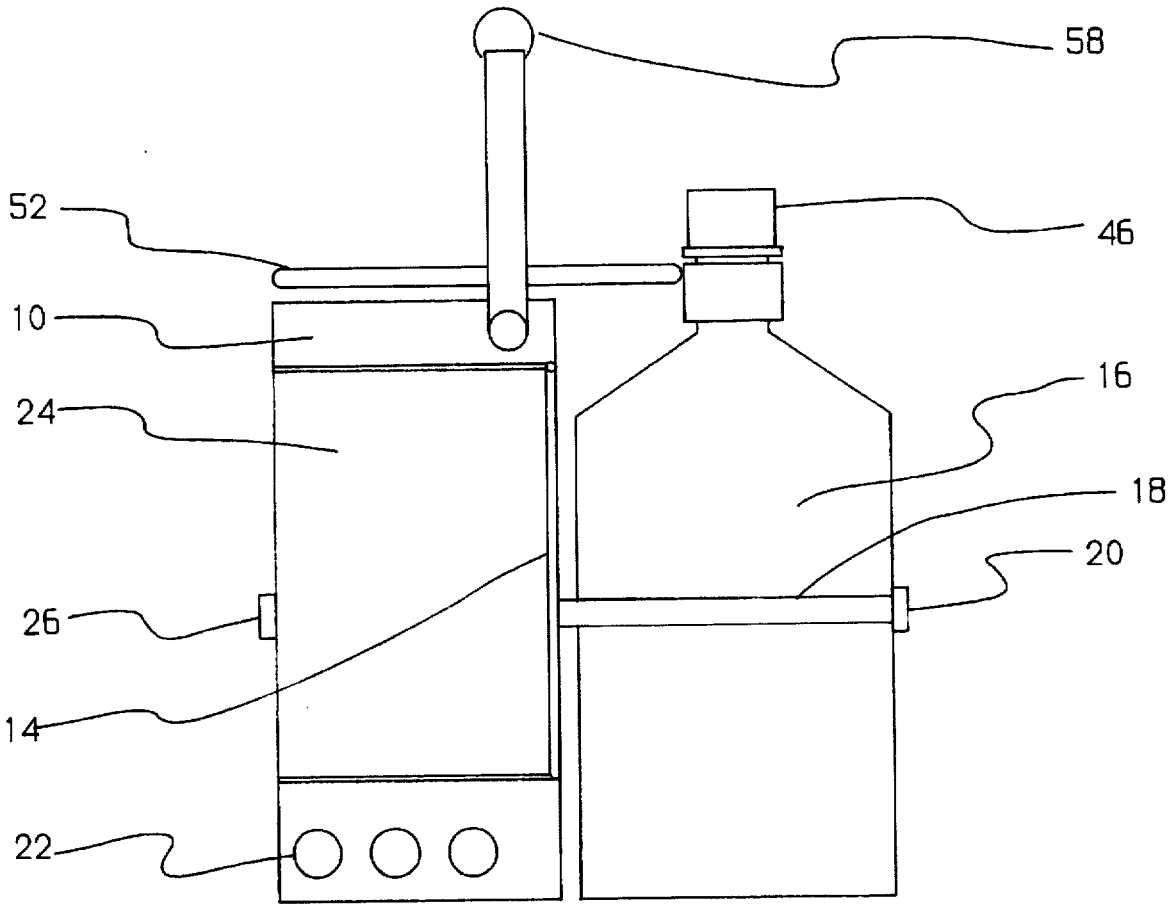
FIG. 2 is an end view of the light/Stove water heating unit showing the handle and fuel container.
Figure 3:
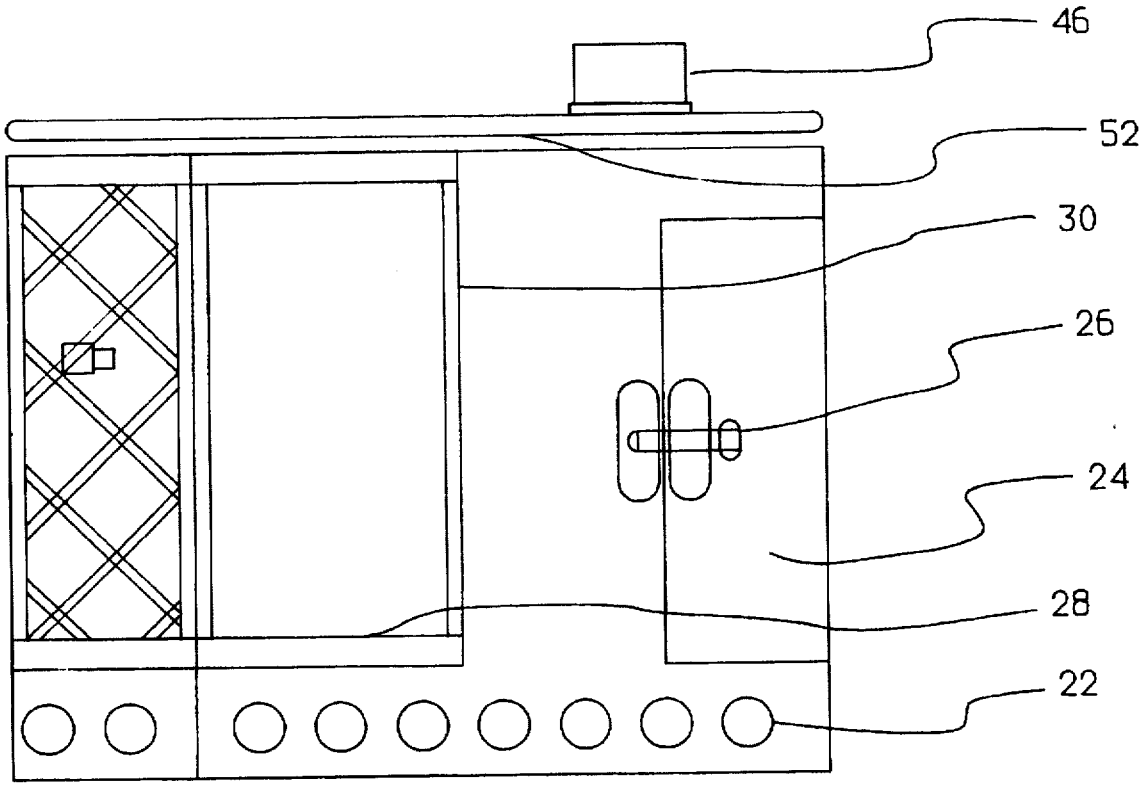
FIG. 3 is a front view of the light/stove water heating unit showing the storage door, door latch and housing door/framework.
Figure 4:
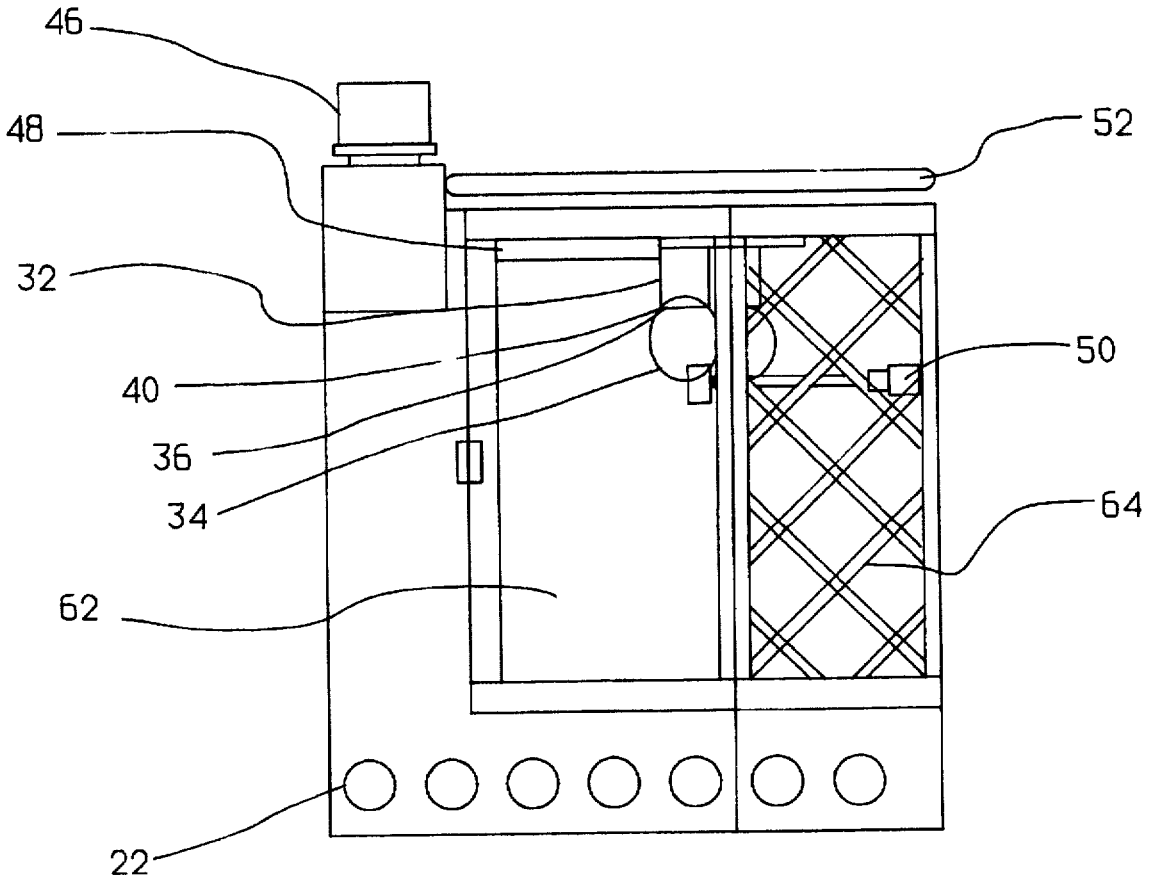
FIG. 4 is an end view opposite of FIG. 2 showing the burner, grill and friction ignitor.
Figure 5:
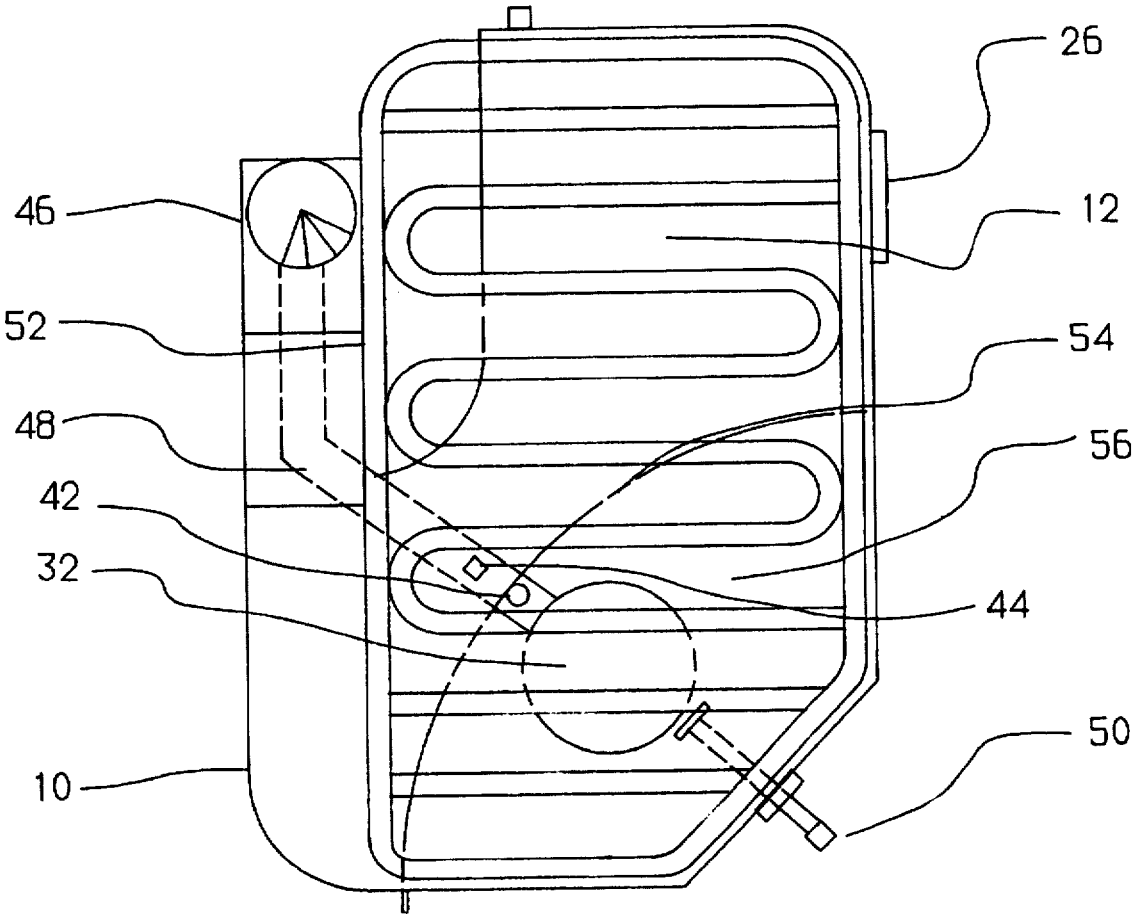
FIG. 5 is a top view in partial cross section of the light/stove water heating unit showing the burner, fuel line, friction ignitor and reflective surfaces.
Figure 6:
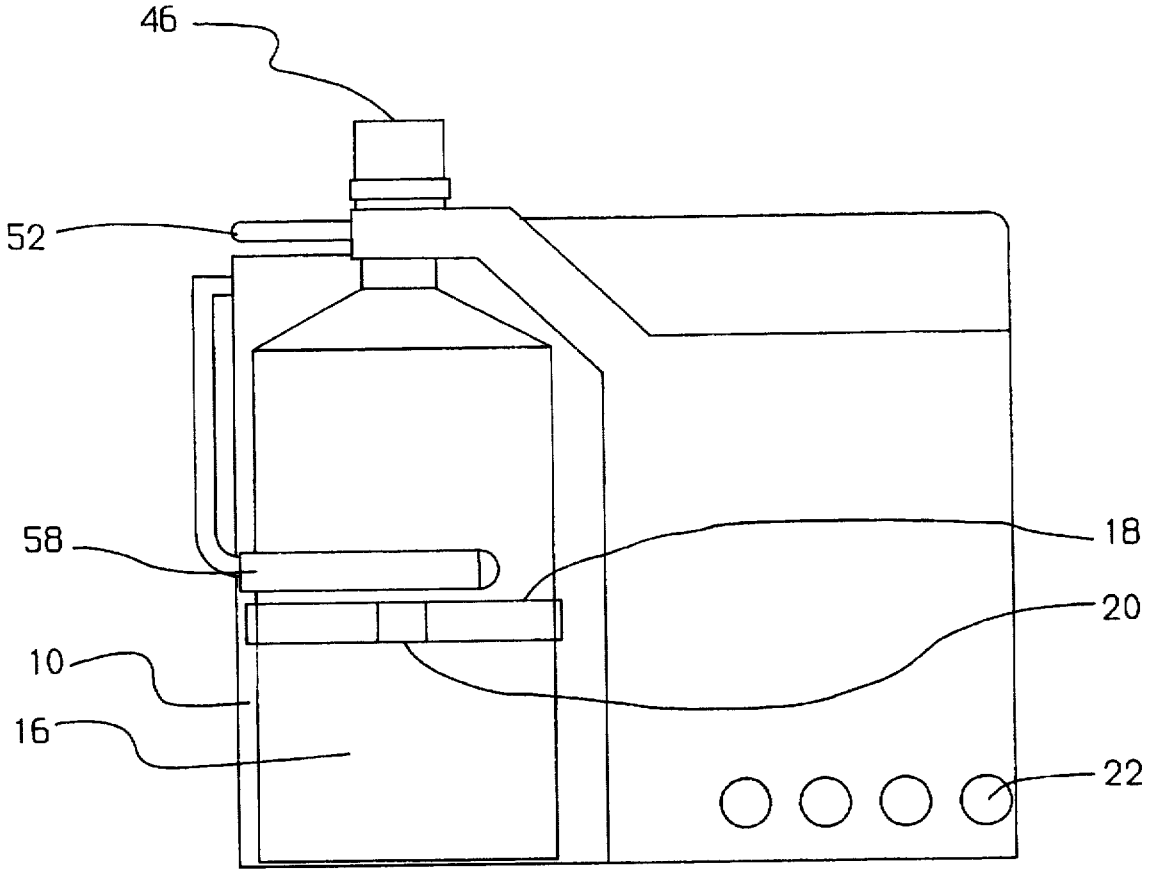
FIG. 6 is a back view of the light/stove water heating unit showing the handle and fuel container.
Figure 7:
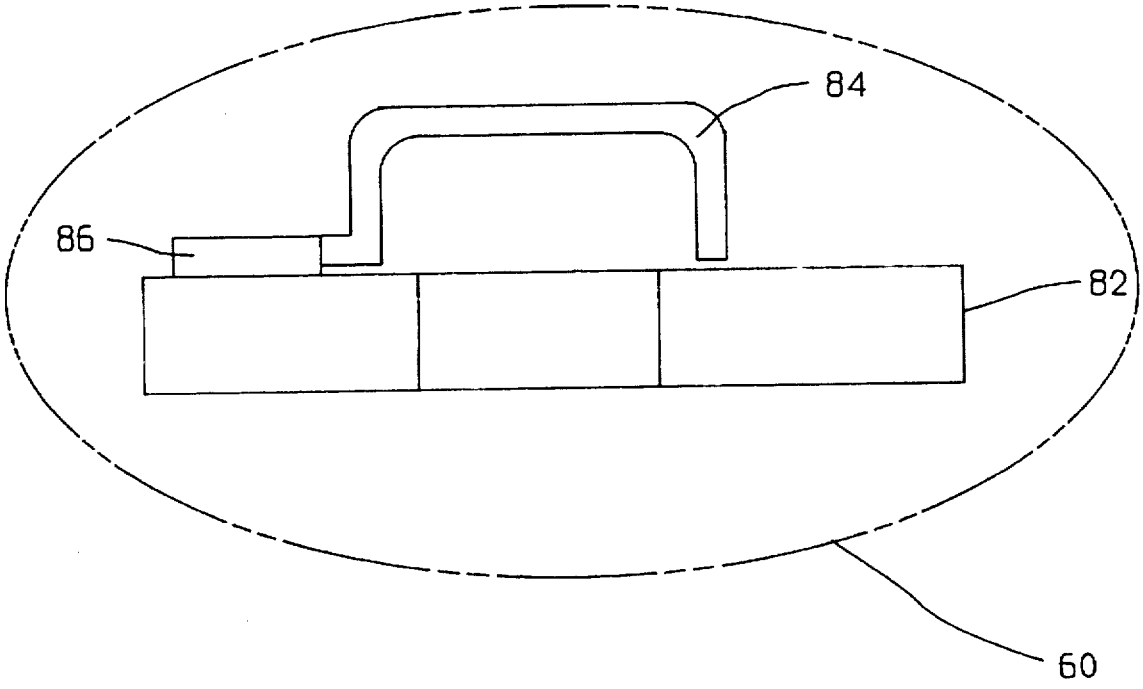
FIG. 7 is a side view of liquid container.
Figure 8:
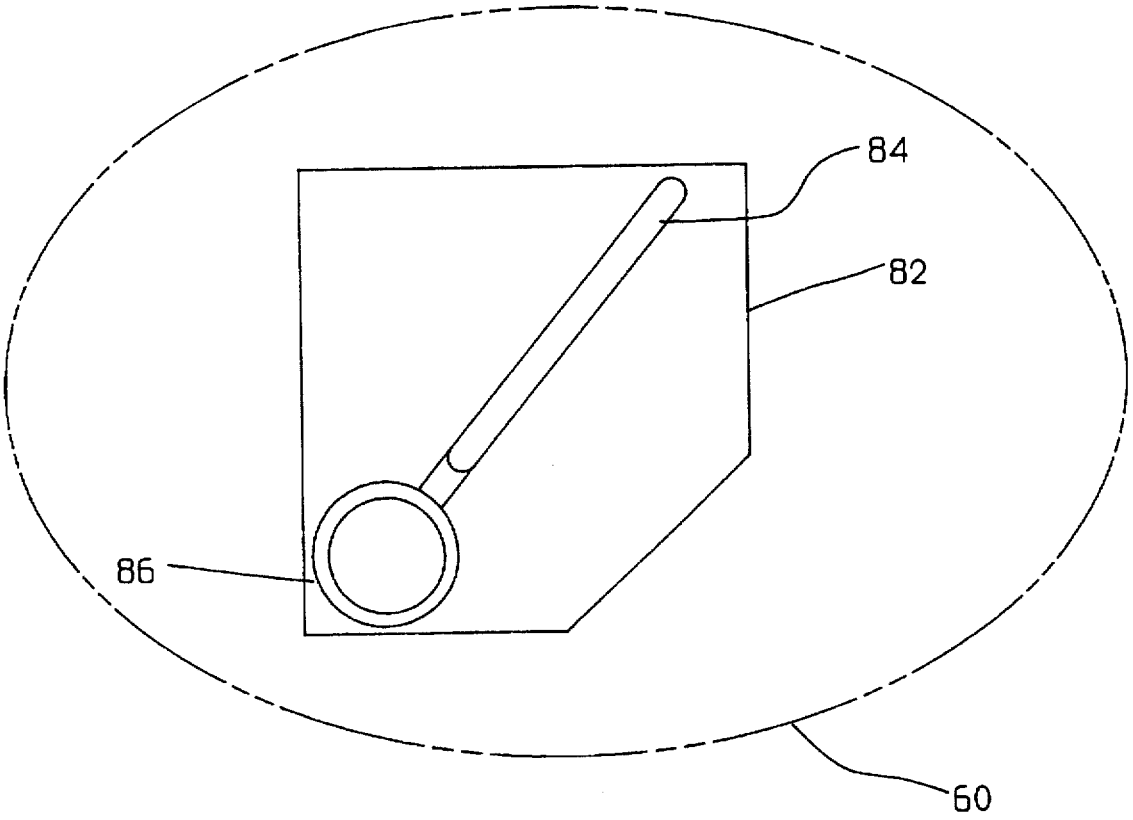
FIG. 8 is a top view of liquid container.
Figure 9:
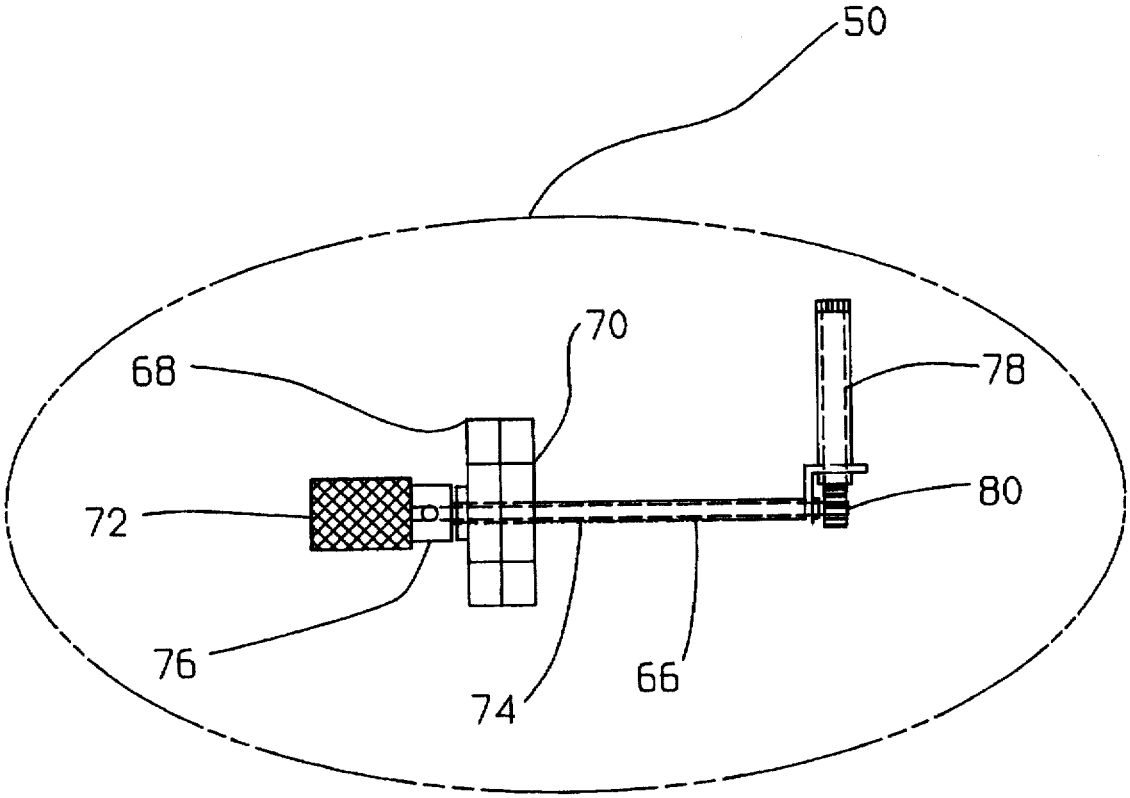
FIG. 9 is a view of friction ignitor.

Referring now to the drawing:

In the illustrated preferred embodiment of the invention as shown on FIGS. 1 thru 9, the combination stove, lantern and liquid heater includes a rectangular shaped housing 10. Housing 10 as shown, has a vertically extended cylindrical shape, but with a quarter section removed to provide space for a conventional pressurized propane fuel container 16 to be mounted within the general confines of the shape. The fuel container 15 is mounted to the housing 10 by means of an adjustable strap 18 which has a buckle 20 that is adjustable to accomodate the fuel container 16. The base of the housing 10 is fitted with cooling air openings 22 located around the perimeter of the base of the housing 10 to allow for cooling air to flow throughout the underside of the unit. A storage area 12 is located within the housing 10 and is contained in the area directly behind the reflective panel 54 that encompass the heated area. This storage area 12 is enclosed by the use of a hinge 14, door 24 and latch 26 and can be used for storage of utensils and other survival related items. The heated area surrounding the burner 32 and mantles 34 is enclosed by a door/framework 28 which is hinged 30 to allow access to the silk refractory mantles 34 for convenience of changing the silk mantles 34 when necessary. The hinged access door/framework 28 consists of 3 separate panels in which two of the panels consist of a fire-resistant glass 62 and the third panel is made of expanded metal 64 which allows combustion air to flow into the burner area. This expanded metal panel 64 also contains the friction ignitor 50, which enables the unit to be safely ignited without any contact of hands in the heated combustion area. A manually operated industry approved regulator fuel control valve 46 is connected to fuel container 16 and is adapted to receive the threaded end of fuel container 16. The fuel valve 46 controls the amount of gas to be released from the container 16. A fuel line 48 communicates between the fuel control valve 46 and burner 32, and as fuel is released under pressure from the fuel container 16 it flows through the fuel line 48 through a industry approved and properly sized orfice 44 and into the burner 32. A swirling action takes place as the fuel enters the burner 32 and air is drawn through an opening 42 in the burner 32 and out through the air holes 40 in the burner 32.

As will be further explained, the fuel is ignited for the lantern, stove and liquid heater by the use of the friction ignitor 50. A rapid twisting motion of the hurled knob 72 activates flint spark wheel 80 which is attached to shaft 74 enclosed in the friction igniter housing 66, which contains the flint magazine 78, or by the introduction of a match in the housing 10 to ignite the fuel as it reaches the burner 32. Friction Ignitor 50 is uniquely attached by the use of attachment nut 68 and lock nut 70 to the door/framework 28 in a manner that provides for the user to safely ignite the mantles 34 and providing for a method of retracting the friction ignitor 50 from the intense heat of the mantles 34 and thus insuring the reliability, endurance and lifespan of the friction ignitor 50.

A grill 52 is located directly above the burner 32 and the balance of the entire housing 10. The grill 52 is attached above reflective surfaces 54 and 56. The open space between the grill 52 and the reflective surfaces 54 and 55 allows for venting of combustion gases as well as heat being applied to the bottom of a liquid heater container 60, A pan or other cooking utensil is placed upon the grill 52 to receive heat from burner 32 which is moving up through the housing 10 in front of the reflective surfaces 54 and 55 when the liquid heater container 60 is not in use. The liquid heating container 60 is built as a removeable utensil which allows liquids to be heated during periods of illumination. Liquid container 60 will hold 2 cups of liquid, and has a handle 84 for a safe and convenient method of pouring of the contents from pour spout 86. When unit is used for light or cooking the liquid heater container 60 can be set aside for use as needed.

During the operation of the unit as a lantern and or for cooking or heating of liquids, fuel is supplied from the pressurized fuel container 16 and is regulated by a control valve 46. The fuel flows through fuel line 48 to orfice 44 and then combustion air is added thru combustion air hole 42 prior to burner 32 and is distributed thru fuel outlet holes 40 into the lantern mantles 34. A conventional silk gas lantern mantle 34 is tied around the preformed burner base plate collar 32 by use of mantle ties 36 and the mantle is supported vertically by lantern mantle support 38. The mantles are filled with the fuel passing through the burner 32; and as the mantle becomes full of gas or fuel escapes through the silk refractory material of the mantle 34 and is ignited by a ignition friction starter 50, or by a lighted match. As the fuel burns in the lantern mantles 34, it provides heat and glows brightly to provide the desired illumination. The reflective surfaces 54 and fixed reflective surface 56, all of which partially surround the lantern mantle 34, reflect the light in the pattern most preferred by the user.

As previously noted, the grill 52 is positioned above the mantles 34 and the heat produced by the combustion of fuel from the lantern mantles 34 provides the source of heat for cooking or heating of liquids.

A handle 58 is fixed to and spaced from the housing 10 and is positioned directly behind the stationery reflective surface 54 that serves as a shield and provides protection for the hand of the user from the heat of the mantle 34. With the handle 58 so positioned, if the mantle 34 is lighted the generated light is reflected by the reflective surface 54 away from the person grasping the handle 58. This is an effective way in lighting a pathway as it is carried. The grip part of the handle 58 is hollow and has removeable ends and is used a storage unit for spare silk refractory mantles 34.

Although the preferred embodiment of this invention has been herein described, it is to be understood that the present disclosure is made by way of example and that variations are possible without departing from the scope of the herein-after claimed subject matter, which subject matter we regard as our invention.

We claim:

1. A combination heater, light source and cooking apparatus which utilizes a containerized fuel comprising a housing, a burner, a grill, a friction ignite and fuel flow control valve, the apparatus further including;

means for connecting a fuel container to the flow control valve and means connecting the valve to the burner structure such that the valve controls the flow of fuel to the burner;

the burner positioned within the housing a reflective wall adjacent the burner to reflect the light produced by the burner to the exterior of the housing and thus provide a light source;

a plurality of transparent heat resistant panels forming part of the wall of the housing such that the illumination produced by the burner and reflected by the reflective wall structure passes through the transparent heat resistant panels;

a grill positioned above the burner for supporting an article placed on the grill and allowing heat produced by the combustion of the fuel to heat the article;

the housing further includes a handle, storage compartment, a support area for the containerized fuel and a mesh forming part of the wall structure;

and an ignite which extends through the mesh structure with one end of the ignite positioned outside the wall of the housing defined by the mesh and the other end positioned adjacent the burner for ignition of the burner when the ignite is operated;

the housing further including air inlets in the wall for introducing air to the housing.

2. A combination heater, light source and cooking apparatus which utilizes a containerized fuel comprising a housing, a burner, a grill, a friction igniter and fuel flow control valve, the apparatus further including;

means for connecting a fuel container to the flow control valve and means connecting the valve to the burner structure such that the valve controls the flow of fuel to the burner;

the burner positioned within the housing a reflective wall adjacent the burner to reflect the light produced by the burner to the exterior of the housing and thus provide a light source;

a plurality of transparent heat resistant panels forming part of the wall of the housing such that the illumination produced by the burner and reflected by the reflective wall structure passes through the transparent heat resistant panels;

a grill positioned above the burner for supporting an article placed on the grill and allowing heat produced by the combustion of the fuel to heat the article;

the housing further includes a handle, storage compartment, a support area for the containerized fuel and a mesh forming part of the wall structure;

an igniter which extends through the mesh structure with one end of the ignite positioned outside the wall of the housing defined by the mesh and the other end positioned adjacent the burner for ignition of the burner when the ignite is operated;

the housing further including air inlets in the wall for introducing air to the housing, and a container for holding a liquid to be heated by the burner; the container having a handle and a shape which matches that of the grill such that the container can be fitted to the grill and housing and a liquid heated while the entire apparatus is being carried, wherein the apparatus can provide heat to the user, heat for heating a container or any object placed on the grill and at the same time provide illumination.

* * * * *